US012012824B2

(12) United States Patent
Hoines et al.

(10) Patent No.: US 12,012,824 B2
(45) Date of Patent: Jun. 18, 2024

(54) THROUGH-TUBING ELECTRICAL SUBMERSIBLE PUMP FOR LIVE WELLS AND METHOD OF DEPLOYMENT

(71) Applicant: Baker Hughes Oilfield Operations LLC, Houston, TX (US)

(72) Inventors: Jason Hoines, Owasso, OK (US); Austin Cookson, Oklahoma City, OK (US); Mahesha Udipi, Houston, TX (US); Loy Peng Koh, Singapore (SG); Luis Castro, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/695,420

(22) Filed: Mar. 15, 2022

(65) Prior Publication Data

US 2023/0295998 A1 Sep. 21, 2023

(51) Int. Cl.

| | |
|---|---|
| ***E21B 34/02*** | (2006.01) |
| ***E21B 29/04*** | (2006.01) |
| ***E21B 33/06*** | (2006.01) |
| ***E21B 43/12*** | (2006.01) |

(52) U.S. Cl.

CPC ..... *E21B 34/02* (2013.01); *E21B 29/04* (2013.01); *E21B 33/06* (2013.01); *E21B 43/128* (2013.01); *E21B 2200/06* (2020.05)

(58) Field of Classification Search

CPC ..... E21B 34/02; E21B 34/04; E21B 29/04; E21B 33/06; E21B 33/068; E21B 33/072; E21B 43/128; E21B 2200/00; E21B 2200/06

See application file for complete search history.

(56) References Cited

U.S. PATENT DOCUMENTS

| | | | | |
|---|---|---|---|---|
| 6,328,111 | B1 | 12/2001 | Bearden | |
| 7,677,320 | B2 | 3/2010 | Shaw | |
| 7,891,428 | B2 | 2/2011 | Martin | |
| 8,714,261 | B2 | 5/2014 | Sbordone | |
| 9,593,561 | B2 | 3/2017 | Xiao | |
| 9,896,897 | B2 | 2/2018 | Brown | |
| 10,605,056 | B2 | 3/2020 | Hartley | |
| 11,125,042 | B1 | 9/2021 | Mukhlifi | |
| 2005/0205262 | A1 * | 9/2005 | Reimert | E21B 33/035 166/360 |

(Continued)

FOREIGN PATENT DOCUMENTS

| | | |
|---|---|---|
| WO | 2019/083352 | 5/2019 |

OTHER PUBLICATIONS

Novomet, "Colibri Cable-Deployed Rigless ESP," https://www.novometgroup.com/products-services/artificial-lift/electrical-submersible-pumping-systems/rigless-colibri-esp/, accessed Mar. 15, 2022, 8 pages.

(Continued)

*Primary Examiner* — Christopher J Sebesta
(74) *Attorney, Agent, or Firm* — Baker Hughes Company

(57) ABSTRACT

In at least one embodiment, a system for an electrical submersible pump (ESP) of a wellbore is disclosed. The system includes a spool and a tubing insert valve to be associated with the wellbore. The spool is to be located above an Xmas tree and is to retain a coil, cable, or wireline that passes through a wellbore and through the tubing insert valve. The coil, cable, or wireline is to be associated with the ESP.

20 Claims, 3 Drawing Sheets

(56) References Cited

U.S. PATENT DOCUMENTS

| | | | | |
|---|---|---|---|---|
| 2014/0158380 | A1* | 6/2014 | Varkey | E21B 43/128 166/386 |
| 2016/0024878 | A1* | 1/2016 | June | E21B 33/04 166/373 |
| 2017/0241222 | A1 | 8/2017 | Mangum | |
| 2018/0223619 | A1 | 8/2018 | June | |
| 2019/0203571 | A1* | 7/2019 | Hartley | E21B 43/126 |
| 2020/0018397 | A1* | 1/2020 | Arteaga | E21B 33/072 |

OTHER PUBLICATIONS

Amirul Adha Amsidom et al., "Truly Rigless: A Word First Through 3-½" Tubing Cable Deployed Electrical Submersible Pump on a Live Well," SPE Asia Pacific Oil and Gas Conference and Exhibition, Oct. 23, 2018, https://onepetro.org/SPEAPOG/proceedings-abstract/18APOG/3-18APOG/D031S024R001/453210, abstract only.

International Search Report and Written Opinion dated Jun. 29, 2023 in corresponding PCT Application No. PCT/US2023/064233.

* cited by examiner

THROUGH-TUBING ELECTRICAL SUBMERSIBLE PUMP FOR LIVE WELLS AND METHOD OF DEPLOYMENT

BACKGROUND

1 Field of Invention

This invention relates in general to electrical submersible pumps (ESPs) for use in well operations, and, in particular, to installation and operation of such an ESP in live wells.

2. Description of the Prior Art

In offshore (or even onshore) oil and gas drilling, wells may not have sufficient natural pressure in an internal formation to support natural flow of well fluid. Furthermore, such natural pressure of an internal formation may decline over time, as well fluid is removed. In instances where wells are used, either for onshore or offshore wells, such wells may have had to be shut down because a natural pressure may not be adequate. Still further, in wells that may continue to produce well fluid but do so at a lower rate than a measured potential, such reduction in production may be due to other factors. For example, a decline in natural pressure of an internal formation may be because of an impairment of a reservoir and/or an increase in fluid gradient.

SUMMARY

In at least one embodiment, a system for an electrical submersible pump (ESP) of a wellbore is disclosed. The system includes a spool and a tubing insert valve to be associated with the wellbore. The spool is to be located above a production or a Christmas (Xmas) tree. The spool is to retain a coil, cable, or wireline that passes through a wellbore and through the tubing insert valve. The coil, cable, or wireline is to be associated with the ESP.

In at least one embodiment, a method for an electrical submersible pump (ESP) of a wellbore is disclosed. The method includes enabling a spool and a tubing insert valve to be associated with the wellbore. A further step of the method includes locating the spool above an Xmas tree. The method includes enabling the spool to retain a coil, cable, or wireline that passes through a wellbore and through the tubing insert valve. The coil, cable, or wireline is to be associated with the ESP.

BRIEF DESCRIPTION OF THE DRAWINGS

Various embodiments in accordance with the present disclosure will be described with reference to the drawings, in which.

DETAILED DESCRIPTION

Figure 1:
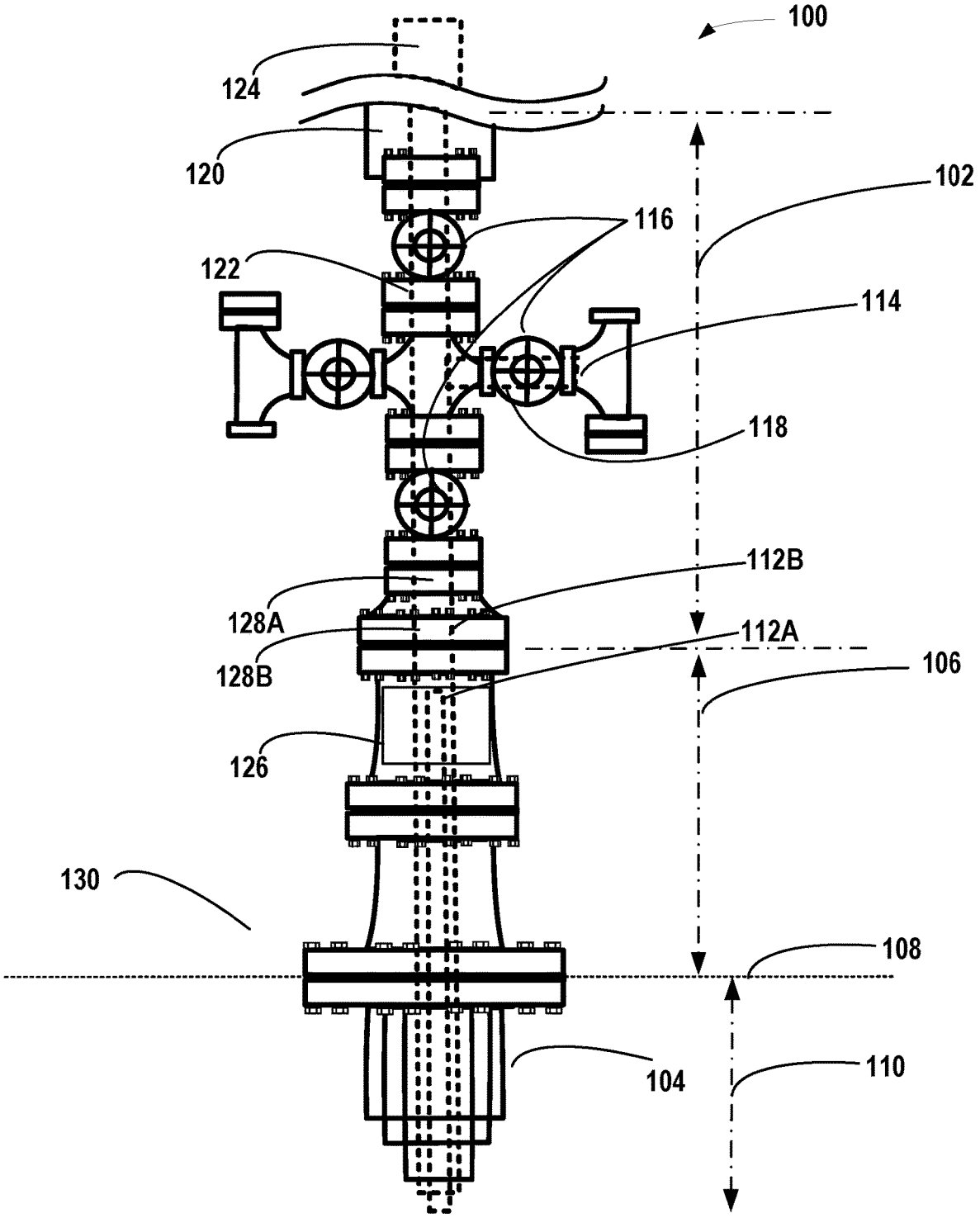
FIG. 1 illustrates a partial schematic view of a well to be associated with an ESP, in accordance with at least one embodiment.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Various other functions can be implemented within the various embodiments as well as discussed and suggested elsewhere herein. In at least an aspect, the present disclosure is to a system and a method for a through-tubing ESP, such as to deploy and to retrieve a through-tubing ESP, in accordance to at least one embodiment.

An ESP may be lowered into a production tubing in an event where a natural pressure of a well declines, which then causes a natural flow rate of well fluid to also decline to an unsatisfactory level. When wells have tubing already installed therein and are required to install an ESP, such an ESP may be introduced into a live well.

To perform such an installation on a live well, it may be required to inject a hydraulic kill fluid into the well. This may be followed by removal of an upper completion and installation of the ESP connected to new upper completion components. The hydraulic kill fluid in this method can damage reservoir performance and removing the upper completion components may be expensive and time consuming. For these reasons, a way to protect the reservoir and minimize changes to the upper completion components is possible using the present system and method. Further, there may be many variations of flange designs found on Xmas trees. As a result, another issue addressed in the present method and system is a lack of or a requirement for multiple components to address the many variations of flange designs.

A live well is a well that has positive pressure at a wellhead. The well may need to be killed before lowering the ESP into the well. The process of injecting a kill fluid into the well is to prevent an accidental blowout while the ESP is being lowered into the well. This process can, however, cause other kinds of damage, such as damage to a formation associated with the well. In an instance, there is a possibility that killing the well may cause the well to not return to its initial natural pressure state.

In at least one embodiment, instead of using a hydraulic kill fluid, the well may be enabled to have at least two pressure barriers. The pressure barriers may be enabled by components supported by a tubing insert valve and by a spool located over a Christmas (Xmas) or production tree. The Xmas tree may be a vertical or a horizontal Xmas tree that may be distinguished, in one example, by positioning of a master valve and swab valves in a vertical arrangement for a vertical Xmas tree or by positioning of a master valve along with a plug for a flow from a sidewall of the Xmas tree in a horizontal arrangement.

In a natural reservoir drive production, well fluid is produced through tubing that is suspended in a wellhead at a sea floor or other terrain surface by a hanger, such as a spool tubing hanger, within a spool. While a spool hanger can seal within the wellhead assembly or the Xmas tree, a spool together with the tubing insert valve can enable components to provide the two pressure barriers as discussed further with respect to FIG. 2, which further enables ESP installation in a live well.

Still further, a safety valve may be installed below the spool and differently than a tubing insert valve associated with the production tubing. In addition, an isolation valve may be located above the Xmas tree and above the safety valve. The isolation valve can enable isolation of the safety valve in a system having the spool above the Xmas tree. The safety valve may be a type of valve that is biased closed and held open with hydraulic fluid pressure. In at least one embodiment, in an event of a hydraulic fluid pressure failure, the safety valve will close. This feature is also to address possible damage to the wellhead assembly, when the safety valve may be caused to shut.

While the tubing insert valve is required to be closed to serve as a pressure barrier during a phase of the installation of an ESP in a well devoid of a hydraulic kill fluid, the tubing insert valve is also required to be open at least in one phase during the installation. For example, the tubing insert valve may be deployed into the well in a tandem manner, on top of the ESP, and may be landed on a safety valve or landing nipple. The ESP, with the coil, cable, or wireline, may be further lowered into their landing positions. The ESP may be located deep within a well, substantially deeper or below the tubing insert valve and just above the perforations leading to the reservoir to achieve an efficient production boost.

In a well with existing upper completion components (such as, having a tubing, an Xmas tree, and flow lines), a system having a spool (with a spool hanger, such as a cable or tubing hanger) and a tubing insert valve may be associated with the one or more of the existing upper completion components. For example, a spool may be connected to a top of Xmas tree to allow an ESP to be deployed through the existing completion. The system may also include one or more tree adapters (that may or may not be part of the spool), a shear valve, one or more isolation valves and a safety valve.

The ESP is installed by first providing the tubing insert safety valve with an inner toroidal or other relevant sealing mechanism to allow an ESP electromechanical cable to pass through and to be sealed on. This enables the ESP to be deployed in a live well which is then devoid of the hydraulic kill fluid, thereby minimizing the chance of damaging the formation. Such features also allow the well to be live and pressurized during installation of the ESP. Such features also remove any requirement for modifications to the upper completion components to save time and money from the requirement and installation of an ESP into a live well.

In at least one embodiment, FIG. 1 illustrates a partial schematic view of a well to be associated with an ESP. In FIG. 1, such a partial schematic view is of a portion of a well assembly 100. Such a wellhead assembly 100 may include an Xmas tree 102. The Xmas tree 102 may be located over a wellbore 104 that has at least a production tubing 112A and an annular casing 112B that extends fully or partly through it. There may be further annular casings or stages of such casings associated with the wellbore. The Xmas tree 102 is located or landed over a high-pressure wellhead housing 104.

In at least one embodiment, such a well assembly 100 may be located on a surface 108 of a sea floor or other terrain 110 and over a well 130. The Xmas tree 102 may have many coupling or flow features, including a vertical flow passage 128A formed of a casing 112B or of a production tube 112A; and a lateral flow passage 114. The lateral flow passage 114 extends laterally outward through a side wall from a production tubing 112A but a separate lateral flow passage may be provided to the annular casing 112B alone.

In at least one embodiment, a production tubing hanger 126 may be landed in a wellhead housing 106 or in an Xmas tree 102, such as, on a landing shoulder or flange provided therein. The wellhead housing 106 may be a high-pressure wellhead housing. In at least one embodiment, a tubing hanger 126 may be landed on a shoulder in the wellhead housing 106 using one of many different types of Xmas trees 102. A tubing hanger may support a vertical flow passage 128A or axial flow passage 128B therethrough that may align with an axis of a production tubing or an annular casing 112A; B. As such, a flow passage 118 may extend laterally from production tubing 112A of a wellbore 104. In at least one embodiment, such a vertical flow passage 128A is provided by any part of a well assembly 100 and not only a wellbore 104 or its tubing and casing parts 112A; B.

In at least one embodiment, an Xmas tree 102 may has various valves 116 for controlling a flow of well fluid, production fluids, or intervention fluids there through, including through various flow passages provided there through and even by a wellbore 104. The valves 116 may include a master valve, a swab valve, and wing valves. Further, when the Xmas tree 102 is horizontal tree, at least a plug may be used instead of a swab valve for the production tubing 112A. Further, a tubing hanger 126 may also have external seals that seal above and below one or more flow passages. A tubing hanger 126 may be located at an upper end of and supports a string of a production tubing, such as an illustrated part 112A along with a casing 112B, of a wellbore 104 that extends through one or more strings of casing 112B from a high pressure wellhead housing 106.

A tubing hanger 126 may have a lock-down device that, when actuated by a running tool, locks a tubing hanger 126 to a profile or groove located on or associated with a production tubing 112A. Further, the tubing hanger 126 may be within an Xmas tree 102 in a horizontal Xmas tree but may be within a wellhead or wellhead housing 106. A tubing hanger 126 may also include a wireline plug profile located within a vertical flow passage for a horizontal Xmas tree. In a natural reservoir drive production, a wireline plug may be located within a passage of the tubing hanger that is aligned with a production tubing 112A and may be locked to a profile associated with the passage of the tubing hanger. Further, a wireline plug may form a seal that may require production fluid to flow out of one or more lateral passages 118.

An Xmas tree 102 may have an external groove or profile that may be of various shapes. In at least one embodiment, for a vertical Xmas tree 102, a tubing hanger 126 may be run to a wellhead housing 106, such as a high-pressure wellhead housing. Then, completing a well associated with a well assembly 100 may include providing a drilling riser with a blowout preventer to connect to a profile of an Xmas tree 102. In an example, a tubing hanger 126 may be lowered through a drilling or other riser 124 and a blowout preventer may be associated with it. After installing a tubing hanger 126 completing and testing of a well may be performed. Then, a drilling riser 124 may be removed and a tree cap 120 may be secured to seal a production tube 112A and other casings 112B associated with a wellbore 104. In at least one embodiment, the tree cap 120 may be an internal tree cap in an Xmas tree 102 for a horizontal Xmas tree.

An Xmas tree 102 may have a tubing annulus passage 128B, also referred to as an axial flow passage, formed from a casing 112B around the production tubing 112A therein. Such a tubing annulus passage 128B may lead to one or more valves 116 (such as a swab valve, an upper master valve, a lower master valve, or wing valves) for opening and closing communication with a tubing annulus passage 128B inside a casing of such an Xmas tree 102 and on an exterior of a production tubing 112A. In at least one embodiment, control of a tubing annulus passage 128B enables circulation of production fluids (different from well fluids) down a production tubing 112A and back up a tubing annulus passage 128B or vice versa.

Figure 2:
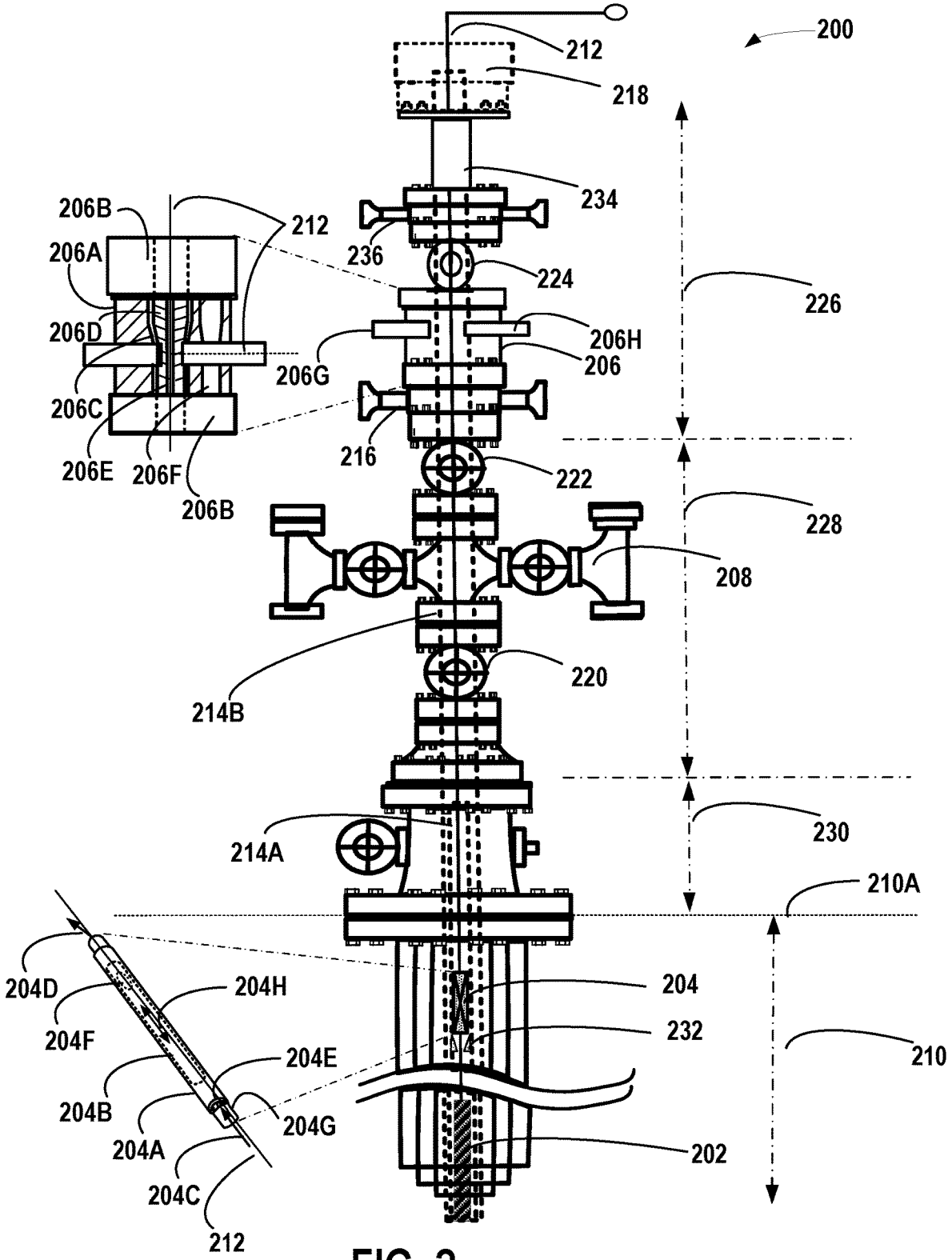
FIG. 2 illustrates a partial schematic view of a well associated with an ESP, in accordance with at least one embodiment.

In at least one embodiment, FIG. 2 illustrates a partial schematic view of a well associated with an ESP. Like in FIG. 1, in FIG. 2, such a partial schematic view is of a portion of a well assembly 200 with a system 202, 204, 206 for an electrical submersible pump (ESP) 202. The ESP 202 is for a wellbore 210. A wellhead or wellhead housing 230 is located on a surface 210A of a sea floor or other terrain 210 over a well 238. The system 202, 204, 206 includes at least a spool 206 and a tubing insert valve 204 to be associated with the wellbore 210. The spool 206 is to be located above an Xmas tree 228 that is associated with a wellhead 230. The spool 206 is to retain a line 212 that passes through a wellbore, such as a production tubing 214A of the wellbore 210.

In at least one embodiment, such a line 212 is also retained to pass through the tubing insert valve 204 during operation of the well. The line 212 is a coil, cable, or wireline that is to be associated with the ESP 202. A coil would be used as the line 212 when the environment is a hasher environment (such as, in hydrogen sulfide environments) requiring protection to features therein. In at least one embodiment, the illustrated line 212 is a reference to one or more cables, coils, or wirelines that may be associated with the ESP at different times, such as, during installation and/or during operation of an ESP. As such, even if illustrated as a single line, the illustrated line 212 is a reference to any number of coils, cables, or wirelines that may be used independent of each other (such as, by severing an existing coil, cable or wireline and introducing a new coil, cable, or wireline) to install or operate the one or more components in the casing.

The tubing insert valve 204 may be located within a production tubing 214A and may be supported by a landing nipple 232. The tubing insert valve 204 may be in a location that is relatively closer to Xmas tree 228, such as in the wellbore 210 just below a surface 210A hosting the wellhead 230. In at least one embodiment, a distance between a top end or a bottom end of the Xmas tree 228 and the tubing insert valve 204 may be no more than a few hundred feet. The tubing insert valve 204 may be much closer to an Xmas tree 228 than to a lower end of a production tubing 214A that is associated with a flow passage of the Xmas tree 228. The production tubing 214A may extend, in part, to thousands of feet below the Xmas tree 228 and may be formed of production tubing sections associated together.

In at least one embodiment, a tubing insert valve 204; an above-Xmas tree safety valve 216, such as a shear valve; and an isolation valve 224, such as an auxiliary swab or an isolation valve may be various types of valves that are employed to close, open, or intervening in a production tubing 214A in the event of an emergency. The safety valve 216 may be biased by a spring to a closed position and has one or more hydraulic lines that lead from the Xmas tree 228 to a safety valve 216 to maintain the safety valve 216 in an open position. A hydraulic line may fluidly couple to a flow passage within a spool hanger that may be a tubing hanger or a cable hanger within a spool, different from the tubing hanger described in FIG. 1. In an event of a loss or when turning off hydraulic fluid pressure to a hydraulic line, the safety valve 216 is enabled to automatically close.

In at least one embodiment, a naturally driven well (such as, an internal formation sustainable with a natural pressure) may include a packer to seal between a casing and a production tubing. The packer may be located above perforations provided within a casing. The perforations may fluidly communicate between a wellbore 210 and a reservoir or formation for producing well fluid. The wellhead assembly 200 includes, at the lower end of production tubing 214A, a sliding valve that may be actuated between open and closed positions to enable circulation between an interior of a production tubing and an annulus (such as, a tubing annulus passage 214B) surrounding the production tubing 214A. The production tubing 214A may terminate in a tubing hanger.

In FIG. 2, an electrical submersible pump (ESP) 202 may be lowered into a production tubing 214A in an event where a natural pressure declines, which then causes a natural flow rate of well fluid to also decline to an unsatisfactory level. In at least one embodiment, as such, an ESP 202 may be introduced into a live well with a line 212 that may be an installation cable, coil, or wireline, and which may be passed through the isolation valve 224.

In at least one embodiment, different types of rotary pumps may be used as an ESP 202. An ESP 202 may be also a collective reference to an ESP assembly that includes components used to operate the ESP 202 or to hold the ESP 202 in position. In at least one embodiment, such components include a downhole motor and a seal section so that the downhole motor is connected to the seal section. The seal section equalizes a pressure of an internal lubricant within a downhole motor with an external well fluid pressure. A further component is a pump that may be a centrifugal pump having many stages. In at least one embodiment, each stage may include an impeller and a diffuser.

In at least one embodiment, an ESP 202 also has a packer incorporated with it. The packer may be a releasable type of packer that seals an annulus between the ESP 202 and an interior of a production tubing 214A. This packer may be located between a pump intake and a pump discharge. The pump discharge may be in an adapter, which is at an upper end of the ESP 202. The ESP 202 may be supported by a conduit connected to the adapter. The conduit may be a string of small diameter production tubing. In at least one embodiment, the conduit may include a string of continuous coiled tubing instead of a wireline. A discharge from pump of an ESP 202 is made to an annular space surrounding such a conduit. In at least one embodiment, pump of the ESP 202 could discharge into an interior of such a conduit, rather than into an annulus surrounding such a conduit.

In at least one embodiment, a flow passage of the Xmas tree 228 has a lateral outlet 208 that includes a wing valve and a surface choke can provide well fluid to a production facility. The well fluid is pumped using the ESP and caused to reach the lateral outlet 208. In at least one embodiment, such a flow passage extends through a side wall of an Xmas tree 228. Seals may be provided to seal a junction between the side wall and the flow passage.

In at least one embodiment, an adapter 206B of the spool 206 enables a connection, between a swab valve 222 of an Xmas tree 228 to either a shear valve 216 that may be in addition to the spool 206 or to a spool 206 directly. The adapter 206B may be a component that can be stocked as a partially completed machined component with a side that connects to an existing swab valve 222 or to a shear valve 216 functioning as a safety valve. The side of the adapter 206B may be left unfinished until a candidate well is identified. This allows the adapter 206B to be easily prepared, such as by design and machining, for the many variations of flange designs found on Xmas trees, shear valves, or on upper completions.

The shear valve 216 may be included as an extra safety barrier that can cut an ESP electromechanical coil, cable or wireline represented by an illustrated line 212 in FIG. 2. The shear valve 216 may be also used to seal the wellbore 210 in case of an emergency. The spool 206 provides a shoulder 206C in the spool body 206A to suspend the ESP 202 using a spool hanger 206D associated with the line 212 that may be provided from a vertical channel 206E or a horizontal channel 206G, 206H. For example, the line 212 is associated with the spool hanger 206D and the spool hanger 206D sits on the shoulder 206C. The spool 206 also uses the vertical channel 206E or a horizontal channel 206G, 206H for electrical power to enter the wellbore 210 through, for example, the provided line 212, during operations.

Further, an isolation valve or auxiliary swab valve 224 provides access to the wellbore for pressure monitoring, chemical treatment, or kill fluid injection (only as a contingency). The isolation valve or auxiliary swab valve 224 may be also used as a safety barrier during live well deployment of an ESP. The swab valve 222 and a master valve 220 of the Xmas tree 228 may be kept open to enable the wireline 212 and the ESP to access the wellbore 210.

The tubing insert valve 204 includes a sealing mechanism, such as a toroidal sealing mechanism, to act as a barrier that can be used on the line 212 during the live well deployment (such as, installation) and also as a barrier for servicing wing valves of an existing Xmas tree 228 to which the system 226 having the spool 206 is deployed. In at least one embodiment, electrical power for a motor of the ESP 202 may be supplied by an electromechanical cable of the line 212 that is spliced on to the line 212 after installation is complete. The electromechanical cable for the ESP 202 may be located within a conduit of the ESP 202. When a discharge of a pump of an ESP 202 is, alternately, to an interior of a conduit, then the electromechanical cable could extend alongside the conduit. The electromechanical cable may include several electrical conductors. For example, there may be three electrical conductors as power for a pump or a motor is provided using three-phase AC power.

In at least one embodiment, each conductor may be covered by one or more layers of insulation. Further, such insulated conductors may be embedded within an elastomeric jacket that frictionally grips an interior side wall of a conduit. In at least one embodiment, a power cable may be installed within a coiled tubing or conduit, instead of a wireline, either by pulling a power cable through a manufactured length of coiled tubing or by installing a power cable while welding a longitudinal seam of a coiled tubing.

An upper end of such a conduit may be connected to a coiled tubing, a cable, or a wireline from a spool hanger 206D. The spool hanger 206D may have an upper or lower tubular portion that lands on a shoulder 206C within a hanger passage of the spool 206. Further, such a hanger passage has one or more seals that seal the upper or lower tubular portion. A spool hanger may include a lockdown device to prevent pressure within a flow passage, such as the bypass passage 206F from pushing it upward. In at least one embodiment, a lockdown device for locking the spool hanger 206D may be actuated by a running tool. For example, the running tool engages a profile on a spool hanger to the spool 206.

In at least one embodiment, electrical conductors of an electromechanical cable 212 may be coupled to a power source on an exterior of Xmas tree 228. For example, a conduit hanger may include an electrical receptacle that faces upward and that provides a wet-mate type coupling. In at least one embodiment, numerical reference 218 is to an end feature associated with an Xmas tree 228. For example, the end feature 218 may be a tree cap or a stuffing box. The end feature 218 may be provided based in part on a state of the wellhead. For example, during installation of an ESP 202, a stuffing box may be provided as the end feature 218, but when in inactive mode for the wellhead, the end feature 218 may be an external type of cap. As such, the end feature 218 is exchangeable with a stuffing box or a tree cap depending on discussion herein of the state of the wellhead.

In at least one embodiment, an external type of a tree cap 218, when used, may be a tree cap that was previously associated with an upper end of an Xmas tree, as discussed in FIG. 1. The tree cap 218 may be associated with the spool 206 or an isolation valve or auxiliary swab valve 224 above the spool. Such a tree cap 218 may include locking members that engage an external profile on an upper adapter 206B of the spool or an adapter associated with the isolation valve or auxiliary swab valve 224. Such locking members may be adapted to hydraulically moved inward and wedged in place.

A tree cap 218 may also include an electrical connector assembly that can mate with an electrical receptacle when installed. An electrical connector assembly may include conductor pins or sleeves that enable it to move from a retracted position to an extended position. Such movement may be caused by a hydraulically or mechanically driven piston with the assistance of a remote operated vehicle (ROV). An external tree cap also seals a tree bore of the production tubing 214A by means of a seal provided there between.

In a live well, when production of a well fluid declines to an unsatisfactory level, a lift-assist using an ESP 202 may be considered for the live well. In at least one embodiment, such a transformation to a lift-assist well may be performed without killing the well. In at least one embodiment, the live well is associated with a spool 206 of a wellbore 218 and with a tubing insert valve 204 so that the live well can be devoid of a hydraulic kill fluid for installation of the ESP 202. In at least one embodiment, a tubing insert valve 204 allows installation of the ESP 202 in the live well which may remain pressurized even if production fluid flow through the wellbore 210 is stopped during the installation.

In at least one embodiment, FIG. 2 also details a tubing insert valve 204 that may be used to allow there through a coil, cable, wireline 212 for installation of and providing power to an ESP 202. The tubing insert valve 204 includes a sliding sleeve 204A to control flow of well fluid from an outside of the tubing insert valve 204 to an inner tube portion 204B of the tubing insert valve 204. This may be achieved by allowing well fluid into a first through-hole 204E of the sliding sleeve 204A and into a second through-hole 204F of an inner tube portion 204B. For example, well fluid pressure that may be enabled by the ESP 202 may cause a sliding movement 204H between the sliding sleeve 204A and the inner tube portion 204B of the tubing insert valve 204.

The flow of well fluid, enabled through at least a passage between the sliding sleeve 204A and the inner tube portion 204B of the tubing insert valve 204, provides additional functionality within a production tube for a system embodying a spool 206 above an Xmas tree 228 and the tubing insert valve 204. In at least one embodiment, this configuration enables installation of an ESP using a wireline through a first conduit 206E of the spool 206 and through a second conduit 204C, 204D (at a center) of the tubing insert valve 204, while production is ongoing in a live well between the inner tube portion 204B and the sliding sleeve 204A.

In at least one embodiment, a tubing insert valve 204 may include sealing provided around the wireline. Furthermore, a tubing insert valve 204 includes a modular section 204G at a bottom so that the tubing insert valve 204 can be replaced to suit different applications in addition to supporting a line 212 there through. Such different applications include chemical injection or monitoring for downhole components. The tubing insert valve 204 enables through-tubing completion operations by a single-trip deployment of an ESP 202, where the tubing insert valve 204 may be deployed into the well, in a tandem manner, on top of the ESP 202.

In at least one embodiment, therefore, the tubing insert valve 204 may be used with any end feature 218, such as a tree cap removed (such as, removed by a remote operated vehicle ("ROV")), which enable two pressure barriers for the well assembly 200. One pressure barrier may be at a seal of the tubing insert valve 204 and another may be at a spool hanger that is installed within a passage 206E of the spool 206. Further, a light intervention riser (such as, a riser 124 as illustrated in FIG. 1) may be installed to an upper end of an Xmas tree 228 with an intervening safety valve 216. A bypass passageway 206F of the spool 206 enables flow of well fluid during installation of an ESP using the system herein.

The light intervention riser may be coupled to a profile of one or more adapters having one or more of an isolation valve or a shear valve 216. Further, one or more blowout preventers ("BOPs") acting together may be provided with a shear or blind ram, a cable pipe ram, and/or a mechanical slip pipe ram/hang off. For example, a BOP 236 may be provided above the isolation valve or auxiliary swab valve 224 and separately from the shear valve 216. In at least one embodiment, such a BOP 236 is removable but the shear valve 216 is retained during operations of a well associated therewith. In at least one embodiment, there may be other equipment, including a choke and kill adapter above the Xmas tree 228. Each of such equipment may be used for well intervention, including for onshore and offshore well intervention. In at least one embodiment, such a light intervention riser may be of an inner diameter that is large enough for an ESP 202 and for a conduit hanger to pass through it.

In at least one embodiment, after connecting a riser, such as the light intervention riser, a removal tool may be used to retrieve a wireline plug from a spool hanger 206D. This may be the case with a vertical wellhead. Once removed, the shear valve 216 maintains a second pressure barrier, with the first pressure barrier still being provided by the tubing insert valve 204. In the absence of the shear valve 216, the spool hanger enables a second pressure barrier. The ESP 202 may be lowered through the riser by a running tool or by a cable, wireline, or coil. The lower end of ESP 202 is placed at a determined distance below a tubing insert valve 204. A spool hanger 206D can be landed on a shoulder 206C in the spool body 206A to support the weight of ESP 202. The spool 206 with the spool hanger 206D may also serve as a plug to replace a plug or cap, such as in FIG. 1, that was initially removed.

In at least one embodiment, in a first phase of the process of installing an ESP 202, a master valve 220 is first closed. Then, the spool 206, which may be a hanger spool, along with an auxiliary swab valve or an isolation valve 224 and BOP 236 may be added to the Xmas tree 228. The BOP 236 may be in addition to a shear valve 216 that may be located below the BOP 236 on the Xmas tree 228.

A lubricator 234 with a packer inside may be also provided. Then, the master valve 220 is opened, along with an existing swab valve 222. When the spool 206, the isolation valve or auxiliary swab valve 224, and the BOP 236 are being added to the Xmas tree 228, the master valve 220 forms a first primary pressure barrier and an existing swab valve 222 forms a first secondary pressure barrier. A packer may be run in and set in the first phase, but during run in, the BOP 236 is a standby primary pressure barrier and a stuffing box (the end feature 218) forms a further secondary pressure barrier. After the packer is run in, the master valve 220 is closed, along with the existing swab valve 222.

In at least one embodiment, a second phase of the installation process includes removing the lubricator 234 and attaching an ESP 202 with a tubing insert valve 204 inside the casing. The master valve 220 is opened, along with the existing swab valve 222, once again. The ESP and the tubing insert valve 204 are run in using an installation version of the illustrated line 212, such as, an installation coil, cable, or wireline, which is also referred to herein as the installation line 212. The BOP 236 (such as a pipe ram) may be closed on the installation line 212 associated with the ESP. The tubing insert valve 204 is also closed over the installation line 212.

The installation process can proceed with removal of the lubricator 234 and the attaching of a mechanical slip to the installation line 212. The lubricator 234 may be reattached and the BOP 236 may be reopened, along with the tubing insert valve 204. A mechanical slip may be lowered into BOP 236. The BOP 236 may be closed on the mechanical slip and the installation line 212. Further, the tubing insert valve 204 may be closed again.

Still further, a third phase of the installation process includes stripping of the lubricator 234 and severing the installation line 212. The severing may occur at the BOP 236, with part of the installation line 212 retained for splicing with a power line to power the ESP. The line 212, once spliced, is referred to as an operational line or operational version of the coil, cable, or wireline. As such, the reference numeral 212 is a general reference to one or more lines that are coils, cables, or wirelines used with an ESP during different phases of installation and operation, such as an installation line used during installation of the ESP and an operational line used during operation of the ESP.

In the third phase, the tubing insert valve 204 is a first primary pressure barrier and the BOP 236 may form a first secondary pressure barrier. After the lubricator 234 is stripped and after severing of the installation 212, the lubricator 234 may be removed and an electrical splice may be made up. The lubricator 234 may be lifted with a hanger lifting tool that is fed through a stuffing box (which may be the end feature 218 during ESP installation) that is over the BOP 236.

The hanger lifting tool may be attached to the spool hanger. From this stage through a fourth phase, the tubing insert valve 204 forms a second primary pressure barrier and the isolation valve or auxiliary swab valve 224 form a second secondary pressure barrier. The lubricator 234 may be attached again. The BOP 236 may be opened, but the tubing insert valve 204 may remain closed over the operational coil, cable, or wireline. Further, as part of the installation process, the spool hanger may be lowered into the spool 206. A lateral electrical connection may be completed for the ESP 202. The hanger lifting tool may then be detached.

In a fourth phase of the installation process, the isolation valve or auxiliary swab valve 224 can be closed, while the tubing insert valve 204 remains closed. The lubricator 234 and BOP 236 may be removed. In at least one embodiment, the isolation valve or auxiliary swab valve 224 may be installed blind. In the fourth phase, the tubing insert valve 204 may be opened and the ESP 202 may be commissioned. In at least one embodiment, the phases may be performed in a different order or altogether without separation of such phases.

Once an ESP 202 is installed and commissioned, any riser used in the installation may be removed and a second pressure barrier continues to be provided by the spool hanger within the spool 206. The first pressure barrier continues to be supplied by a seal of the tubing insert valve 204 that is formed around the wireline 212. Further, after securing an Xmas tree cap, an ROV may be used to cause an electrical connector to make a wet-mate connection with contacts in an electrical receptacle. For example, the ROV may be used to connect electrical lines leading from a tree cap to a power source located offshore.

Once the ESP 202 is fully installed, the tubing insert valve 204 may be opened and electrical power may be supplied to motor. The well fluid flows up production tubing 214A and into an intake of a pump of the ESP 202. The well fluid may then flow out discharge ports in the adapters 206B of the spool 206. The well fluid may flow out a vertical flow passage provided in the spool 206.

In at least one embodiment, the system 202, 204, 206 herein can address issues of a hanger spool required to be connected to a hanger or hanger adapter where an existing Xmas tree is initially placed. For instance, an existing Xmas tree may not be used during installation of an ESP or the existing Xmas tree must be deployed higher up in an upper completion surface equipment. Such a requirement changes flow passages ways associated with the Xmas tree. The present spool having a spool hanger above the existing Xmas tree 228 allows the Xmas tree 228 and flow passages to stay in place which simplifies a workover procedure.

Figure 3:
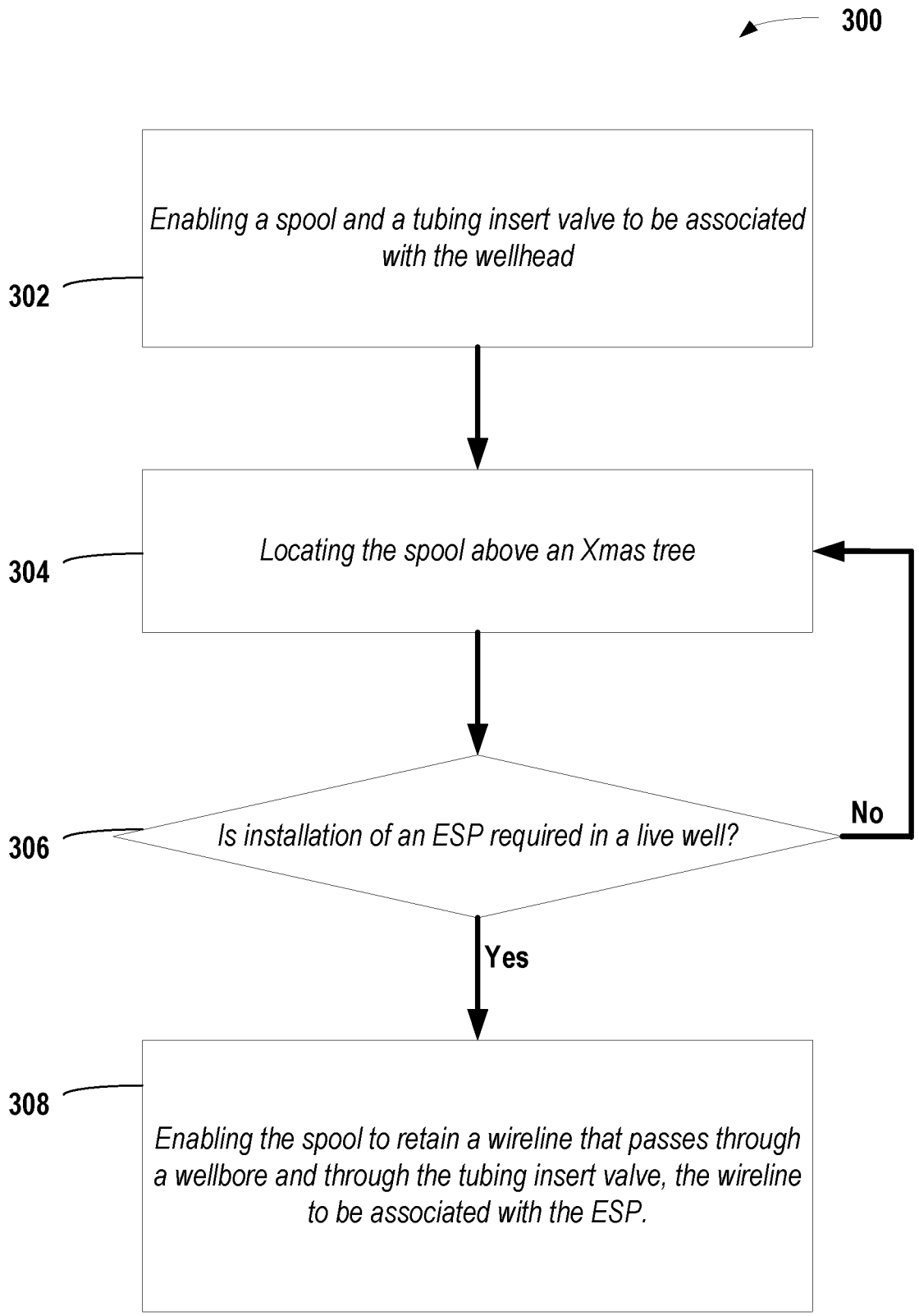
FIG. 3 illustrates a flowchart of a method to be used with a well associated with an ESP, in accordance with at least one embodiment.

In at least one embodiment, FIG. 3 illustrates a flowchart of a method (300) to be used with a well associated with an ESP. For example, the method (300) may be performed to install an ESP in a live well. The method (300) includes enabling (302) a spool and a tubing insert valve to be associated with the wellbore. The spool may be prepared at an adapter of the spool to enable a coupling with a flange or other existing feature of an Xmas tree, as discussed in reference to FIG. 2. The tubing insert valve may be run into the wellbore as also discussed in reference to FIG. 2.

The method (300) further includes locating (304) the spool above an Xmas tree, such as by attaching the spool to the flange or the other existing feature of the Xmas tree. The method (300) includes verifying (306) that an installation of an ESP is required for a well that is live and that includes an Xmas tree. The locating step 304 may be performed for the Xmas tree to include a spool for the ESP if the verification is negative so that the spool may be used when the ESP is required subsequently during operation of the well. A positive verification from the step 306 may be followed by enabling (308) the spool to retain a wireline that passes through a wellbore and through the tubing insert valve. The wireline can be associated with the ESP, such as to enable lowering of the ESP into the live well through the spool and through the tubing insert valve. Further, the wireline may be retained by the spool to hold the ESP in a desired position in the live well.

The method (300) includes a further step or a sub-step for enabling first production features and valves to be associated with a top side of the spool using one or more tree adapters. The one or more tree adapters may be part of the spool. The features and valves may include at least the flange of a cap or a plug and/or an isolation valve having a flange. The method (300) includes a further step or a sub-step for enabling a bottom side of the spool to be coupled to second production features associated with the Xmas tree using the one or more tree adapters. The second production features may include at least a flange of an Xmas tree or of a safety valve. Furthermore, the wireline may include an ESP electromechanical cable.

The method (300) includes a further step or a sub-step for enabling, using an inner toroidal seal of the tubing insert valve, the ESP electromechanical cable to pass through the tubing insert valve and to seal around the ESP electromechanical cable. In the method (300), the live well may be associated with a wellbore so that the live well is devoid of hydraulic kill fluid for installation of the ESP. Instead, the tubing insert valve allows installation of the ESP in the live well. The live well may not be producing well fluid during deployment, instead, the pressure barriers in place will be closed and may not allow production. The well may remain live as it is pressurized even though it is not producing.

The method (300) includes a further step or a sub-step for installing, using the tubing insert valve, the ESP in the live well with pressure barriers enabled. The method (300) includes a further step or a sub-step for determining an emergency associated with the wellbore. Then, the method (300) enables cutting the wireline or sealing the wellbore using a BOP associated with the spool.

The method (300) includes a further step or a sub-step for suspending the ESP and the wireline from a shoulder of the spool. For example, a spool hanger may be provided within the spool and the wireline may be held in the spool hanger with the spool hanger resting on a shoulder of the spool, as illustrated in spool 206 of FIG. 2. The method (300) includes a further step or a sub-step for intervening into the wellbore, using an isolation valve of the spool. The intervention is for providing one or more of electrical power to features, such as the ESP within the wellbore. Further, the intervention may be used for providing pressure monitoring, chemical treatment, hydraulic kill fluid (to be used as a backup to the tubing insert valve) to features within the wellbore.

The method (300) includes a further step or a sub-step for enabling a cable or spool hanger within the spool to include a main passage for the wireline and a bypass passage for production fluid to flow during installation of the ESP. The method (300) includes a further step or a sub-step for resting the cable or spool hanger on a shoulder of the spool for using with the ESP.

The specification and drawings are, accordingly, to be regarded in an illustrative rather than a restrictive sense. It will, however, be evident that various modifications and changes may be made thereunto without departing from the broader spirit and scope of the invention as set forth in the claims. Further, any of the many embodiments disclosed here may be combined by a person of ordinary skill using the present disclosure to understand the effects of such combinations.

What is claimed is:

1. A system for an electrical submersible pump (ESP) of a wellbore, the system comprising:

a tubing insert valve to be within a tubing that is inside the wellbore and a spool to be located above an Xmas tree, the spool to retain a coil, cable, or wireline that passes through the wellbore and through the tubing insert valve with the tubing insert valve in a closed position over the coil, cable, or wireline, wherein the coil, cable, or wireline is to remain operational and is to remain associated with the ESP with the tubing insert valve being in the closed position, wherein the tubing insert valve comprises a center conduit which is in the closed position with the coil, cable, or wireline there through, comprises an inner tube portion that is outside the center conduit, and comprises a sliding sleeve to allow fluid flow communication from outside the tubing insert valve to the inner tube portion in the closed position of the tubing insert valve.

2. The system of claim 1, further comprising:

a safety valve to be located above the Xmas tree and to be associated with the wellbore to provide a safety feature for the system.

3. The system of claim 1, further comprising:

an isolation valve to be located above the Xmas tree and above a safety valve, the isolation valve to enable isolation of the safety valve in the system.

4. The system of claim 1, further comprising:

one or more tree adapters to enable first production features and valves to be associated with a top side of the spool and to enable a bottom side of the spool to be coupled to second production features associated with the Xmas tree.

5. The system of claim 1, further comprising:

an ESP electromechanical cable comprised in or forming the coil, cable, or wireline; and an inner toroidal seal of the tubing insert valve to enable the ESP electromechanical cable to pass through the tubing insert valve and to seal around the ESP electromechanical cable.

6. The system of claim 1, further comprising:

a live well associated with the wellbore, the live well devoid of hydraulic kill fluid for installation of the ESP, wherein the tubing insert valve allows installation of the ESP in the live well in a tandem arrangement with the ESP, the tubing insert valve located above the ESP in the tandem arrangement.

7. The system of claim 1, further comprising:

a removable BOP or a shear valve to enable cutting of the coil, cable, or wireline or sealing of the wellbore in response to an emergency.

8. The system of claim 1, further comprising:

a shoulder of the spool to suspend the ESP and the coil, cable, or wireline therefrom, wherein the spool supports an isolation valve for electrical power to enter the wellbore.

9. The system of claim 1, further comprising:

an isolation valve to enable access to the wellbore for one or more of pressure monitoring, chemical treatment, hydraulic kill fluid, or electrical power to enter the wellbore.

10. The system of claim 1, further comprising:

a spool hanger within the spool, the spool hanger to rest on a shoulder of the spool and to comprise a main passage for the coil, cable, or wireline and a bypass passage for production fluid to flow during installation of the ESP.

11. A method for an electrical submersible pump (ESP) of a wellbore, the method comprising:

enabling a spool to be located above an Xmas tree and a tubing insert valve to be within a tubing that is inside the wellbore; and enabling the spool to retain a coil, cable, or wireline that passes through the wellbore and through the tubing insert valve, with the tubing insert valve to be in a closed position over the coil, cable, or wireline, wherein the coil, cable, or wireline is to remain operational and is to remain associated with the ESP with the tubing insert valve being in the closed position, wherein the tubing insert valve comprises a center conduit which is in the closed position with the coil, cable, or wireline there through, comprises an inner tube portion that is outside the center conduit, and comprises a sliding sleeve to allow fluid flow communication from outside the tubing insert valve to the inner tube portion in the closed position of the tubing insert valve.

12. The method of claim 11, further comprising:

enabling first production features and valves to be associated with a top side of the spool using one or more tree adapters; and enabling a bottom side of the spool to be coupled to second production features associated with the Xmas tree using the one or more tree adapters.

13. The method of claim 11, wherein enabling the spool to be associated with the wellbore further comprises:

closing a master valve;

adding the spool, an auxiliary swab valve or an isolation valve, and a blowout preventer (BOP) to the Xmas tree;

providing a lubricator with a packer above the BOP;

opening the master valve and an existing swab valve that is associated with the wellbore running and setting a packer; and closing the master valve and the existing swab valve.

14. The method of claim 13, wherein enabling the tubing insert valve to be associated with the wellbore further comprises:

removing the lubricator;

attaching the ESP with the tubing insert valve inside a casing;

opening the master valve and the existing swab valve;

running in the ESP and the tubing insert valve using an installation version of the coil, cable, or wireline; and closing the BOP and tubing insert valve on the installation version of the coil, cable, or wireline.

15. The method of claim 14, wherein enabling the spool to retain the operational coil, cable, or wireline that passes through the wellbore and through the tubing insert valve, further comprises:

severing the installation version of the coil, cable, or wireline;

enabling the tubing insert valve to provide a first primary pressure barrier and the BOP to provide a first secondary pressure barrier;

making an electrical splice for the ESP to form an operational version of the coil, cable, or wireline;

enabling the tubing insert valve to provide a second primary pressure barrier and the auxiliary swab valve or the isolation valve to provide a second secondary pressure barrier;

opening the BOP with the tubing insert valve remaining closed over the operational version of the coil, cable, or wireline;

lowering a spool hanger into the spool;

completing a lateral electrical connection for the ESP;

closing the isolation valve or auxiliary swab valve; and opening the tubing insert valve with the ESP commissioned.

16. The method of claim 13, further comprising:

installing the ESP in the live well using the tubing insert valve in a tandem arrangement with the ESP, the tubing insert valve located above the ESP in the tandem arrangement.

17. The method of claim 11, further comprising:

determining an emergency associated with the wellbore; and cutting the coil, cable, or wireline or sealing the wellbore using a removable BOP or a shear valve.

18. The method of claim 11, further comprising:

suspending the ESP and the coil, cable, or wireline from a shoulder of the spool.

19. The method of claim 11, further comprising:

intervening into the wellbore, using an isolation valve of the spool, for providing one or more of electrical power, pressure monitoring, chemical treatment, hydraulic kill fluid for features within the wellbore.

20. The method of claim 11, further comprising:

enabling a spool hanger within the spool to comprise a main passage for the coil, cable, or wireline and a bypass passage for production fluid to flow during installation of the ESP; and resting the spool hanger on a shoulder of the spool for using with the ESP.

* * * * *